US005203558A

United States Patent [19]

An

[11] Patent Number: 5,203,558

[45] Date of Patent: Apr. 20, 1993

[54] UNIDIRECTIONAL FLEXIBLE SPINNER

[76] Inventor: Benjamin J. An, 2520 Bunker Hill, Ann Arbor, Mich. 48105

[21] Appl. No.: 572,771

[22] Filed: Aug. 27, 1990

[51] Int. Cl.[5] ..... A63B 61/00

[52] U.S. Cl. ..... 273/29 A; 273/26 E; 273/26 R

[58] Field of Search ..... 273/29 A, 26 R

[56] References Cited

U.S. PATENT DOCUMENTS 4,460,172 7/1984 Hogan ..... 273/29 A
4,531,734 7/1985 Herrick ..... 273/29 A
4,830,371 5/1989 Lay ..... 273/26 A

*Primary Examiner*—Theatrice Brown
*Attorney, Agent, or Firm*—Dressler, Goldsmith, Shore, Sutker & Milnamow, Ltd.

[57] ABSTRACT

An unidirectional Flexible Spinner used in teaching and training the action of hitting in games such as tennis or baseball is provided. The Unidirectional Flexible Spinner consists of a spherical object which spins upon hitting, and a flexible section with a nonspherical cross sectional structure which flexes back and forth in approximately the same plane.

4 Claims, 2 Drawing Sheets

UNIDIRECTIONAL FLEXIBLE SPINNER

BACKGROUND OF THE INVENTION

The present invention is intended to simulate a more precise process of Racquet-Ball collision process thus the game of tennis can be more effectively taught and trained.

Numerous attempts had been made by others in the past to create a device in helping teaching and training the game of tennis. But nothing has come close to a timed rhythmic dynamic collision phenomenon thus the actual process of hitting can be studied and practiced.

It is the primary object of the present invention to provide a device that has a precise ball spin and timed rhythmic ball bounce when Racquet-Ball collision process takes place.

SUMMARY OF THE INVENTION

In accordance with the present invention, an much improved training tool which can create spin as well as rhythmic bounce for racquet sports is provided. This hitting tool consists of a spherical object with a hollow tubular axis, and a bounce section with a nonspherical cross section structure to control the direction of bounce.

The spinning section consists of a spherical object which besect a plane formed by the supporting frame. The spherical object spins up or down by swing a racquet from low to high or from high to low. The spinning section extends downward and terminates at the upper end of the bounce section. The bounce section, in no event, is higher than the spining section.

The bounce section begins at the lower end of the spinning section and extended downward for specific distance. The flexible unit in the bounce section can be varied from 2 inches to 36 inches long. The bounce section is protected by a rubberized tubular housing which can be cylindrical or noncylindrical.

Further objects, features and advantages of the present invention will become apparent from a consideration of the following description when taken in connection with the appended claims and the accompanying drawing in which:

Figure 1:
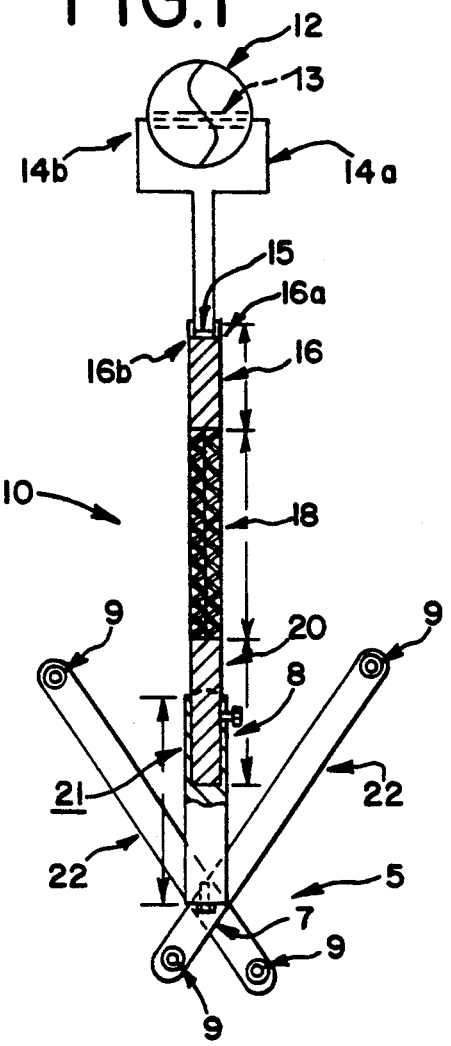
FIG. 1 is a diagrammatic frontal view of the unidirectional flexible spinner.
Figure 2:
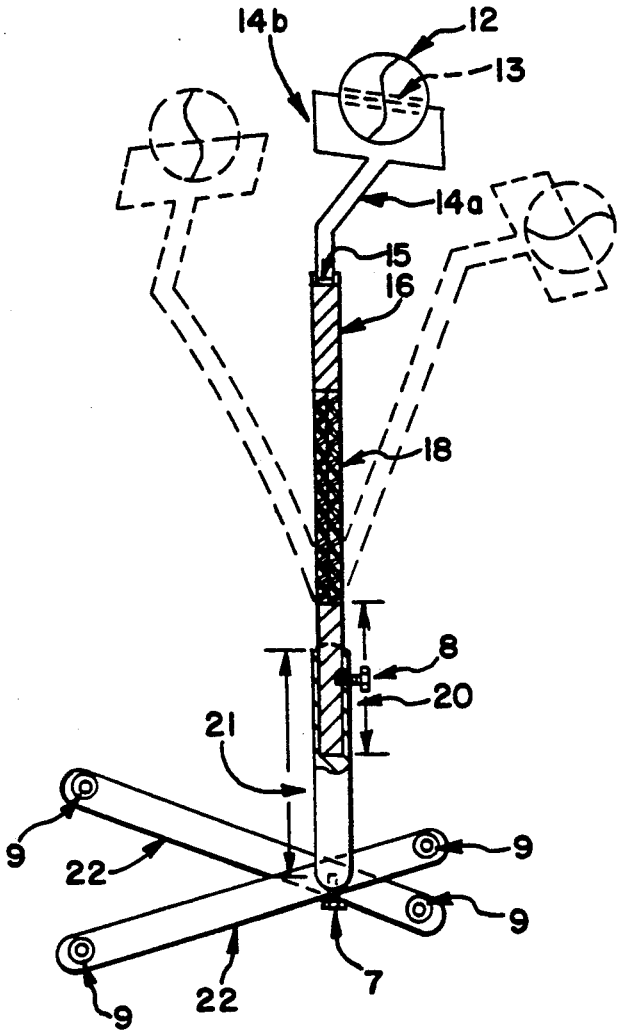
FIG. 2 is a pictorial side view of the unidirectional flexible spinner in action.
Figure 3:
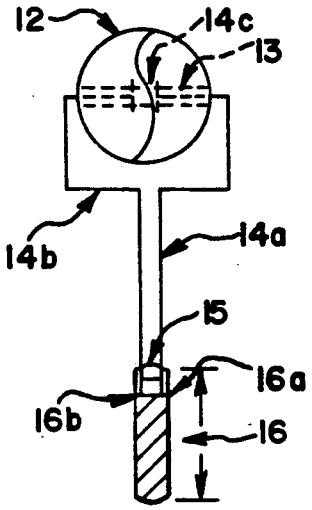
FIG. 3 is a fragmentary frontal view of the spinning section.
Figure 4:
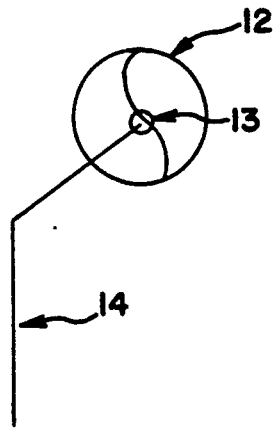
FIG. 4 is a fragmentary side view of the spinning section.
Figure 5:
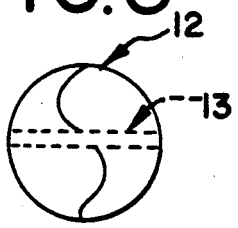
FIG. 5 is an elevational view of a spiner with a hollow axis.
Figure 6:
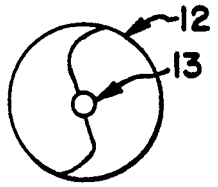
FIG. 6 is a side view of a spinner with a hollow axis.
Figure 7:
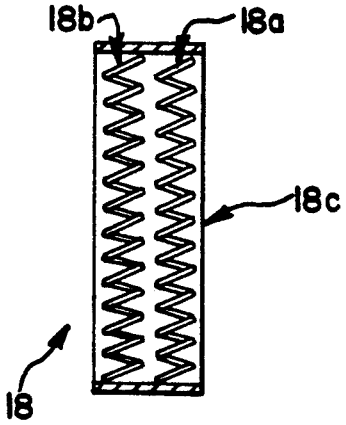
FIG. 7 is a fragmentary frontal view of the flexible section.
Figure 8:
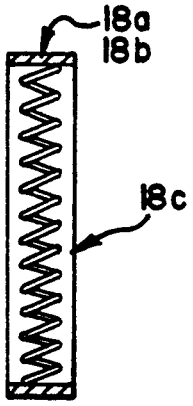
FIG. 8 is a fragmentary side view of the flexible section.
Figure 9:
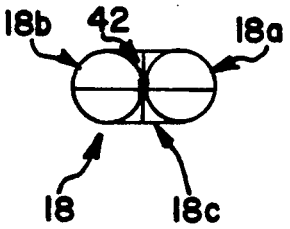
FIG. 9 is a cross sectional view of the flexible unit.

Referring to the drawing, a Unidirectional Flexible Spinner, illustrated generally at 10 in FIG. 1 is provided with a spherical spinning object 12, an imaginary plane surface formed by the supporting frame 14 and a unidirectional nonspherical flexor 18 embodying the present invention. The Unidirectional flexible Spinner 10 includes the Spinner-flexor connecting section 16, flexor supporting column 20 and the Base 22. FIG. 2 shows the flexible-spinner in action. The spherical spinner 12, the supporting frame 14 and the nonspherical flexor all oscillate with approximate same angular velocity and in approximately the same plane. FIG. 5 and FIG. 6 show the elevational view and the side view of the spinner independently. The special characteristics of the spinner is the rigid hollow tubular axis. FIG. 7 is the frontal view of the flexible section 18 with the rubber housing 50. FIG. 8 represents the side view of the flexible section. FIG. 9 is the elevational view of the cross section of the flexible section. The over-all cross section can be formed by a group of small cylindrical units or by a single noncylindrical unit. There is a major axis 40 and a minor axis 42 of the cross section. The major axis 40 is always greater than the minor axis 42.

What is claimed:

1. A ball-hitting practice device which is adapted to redirect motion of a hit ball to a rhythmic motion in a uniplanar predetermined direction, comprising:

supporting means for supporting said practice device on a practice surface;

an elongated flexible section joined at one end to said supporting means and projecting therefrom, said flexible section being formed by two elongated cylindrical springs, said springs having first and second ends, said springs further being aligned in side-by-side relationship and defining a plane, means attaching said springs to each other at said first and second ends thereof, said first ends of said springs being joined to said supporting means;

a ball defining an axis which extends along a diameter thereof; and attachment means attaching said ball at said axis to said second ends of said springs, opposite of said supporting means, and means attaching said first end of said springs to said support means, so that said ball tends to move in a direction generally transverse to said plane when hit by a batter.

2. The device of claim 1 wherein a flexible housing surrounds said flexible section and urges said springs toward each other at a point intermediate the ends of the springs.

3. The device of claim 1 wherein said attachment means is configured to position said ball such that said axis is parallel to said plane defined by said springs.

4. The device of claim 1 wherein the ball is freely rotatable about said axis.

* * * * *